US009662683B2

(12) United States Patent
Campbell

(10) Patent No.: US 9,662,683 B2
(45) **Date of Patent: *May 30, 2017**

(54) HAND-HELD TANK FOR CLEANING CHANDELIERS

(71) Applicant: Inventive Solutions, LLC, Exeter, NH (US)

(72) Inventor: Keith S. Campbell, East Kingston, NH (US)

(73) Assignee: Inventive Solutions, LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/811,028

(22) Filed: Jul. 28, 2015

(65) Prior Publication Data

US 2015/0328666 A1 Nov. 19, 2015

Related U.S. Application Data

(62) Division of application No. 13/780,902, filed on Feb. 28, 2013, now Pat. No. 9,114,442, which is a division (Continued)

(51) Int. Cl.
*A47L 7/00* (2006.01)
*B08B 3/02* (2006.01)

(Continued)

(52) U.S. Cl.
CPC *B08B 3/04* (2013.01); *A47L 7/00* (2013.01); *A47L 7/0095* (2013.01); *B08B 3/026* (2013.01); *B08B 11/02* (2013.01); *B08B 17/00* (2013.01)

(58) Field of Classification Search
CPC ..... A47K 3/10; A61C 17/036; A61H 33/028; B08B 2203/0229; B08B 3/044; B08B 3/104
See application file for complete search history.

(56) References Cited

U.S. PATENT DOCUMENTS 3,132,657 A * 5/1964 Ciccone ..... A61C 17/036 134/188
4,485,503 A * 12/1984 Rolando ..... A47K 3/022 4/622

(Continued)

FOREIGN PATENT DOCUMENTS

| | | |
|---|---|---|
| JP | 06039354 | 2/1994 |
| JP | 07041841 | 7/1995 |
| JP | 2557937 | 9/1996 |

OTHER PUBLICATIONS

International Search Report and Written Opinion with mailing date of Feb. 10, 2012 for international patent application No. PCT/US2011/040841 with an international filing date of Jun. 17, 2011 in the name of the same applicant.

(Continued)

*Primary Examiner* — Todd E Manahan
*Assistant Examiner* — Jennifer Gill
(74) *Attorney, Agent, or Firm* — Nicholas Pfeifer; Smith & Hopen, P.A.

(57) ABSTRACT

An apparatus for cleaning chandeliers includes a hand-held tank for holding hot water and a base supporting the hand-held tank. The base has a hollow interior. The tank has sidewalls, at least one of which is transparent. An air and water pump and a battery are mounted in the hollow interior. The battery is in electrical communication with the pump. A first inlet admits ambient air into an inlet of the pump and a second inlet admits water into the inlet. At least one air and water-emitting nozzle is formed in a sidewall of the tank. A pump outlet is in open fluid communication with the at least one water-emitting nozzle. The at least one nozzle discharges agitating water and bubbles into the hot water or (Continued)

above the water line, depending upon the water depth, to help dislodge chemicals and grease from chandelier parts immersed in the hot water.

4 Claims, 2 Drawing Sheets

Related U.S. Application Data of application No. 12/817,625, filed on Jun. 17, 2010, now Pat. No. 8,402,596.

(51) Int. Cl.

| | |
|---|---|
| ***B08B 17/00*** | (2006.01) |
| ***B08B 3/04*** | (2006.01) |
| ***B08B 11/02*** | (2006.01) |

(56) References Cited

U.S. PATENT DOCUMENTS 5,010,605 A * 4/1991 Shiina ..... A61H 33/0087 4/488
5,603,773 A * 2/1997 Campbell ..... B08B 3/12 134/1
5,671,664 A * 9/1997 Jacobson ..... A23B 7/0205 134/102.3
5,863,343 A 1/1999 Campbell
5,906,216 A * 5/1999 Barlet ..... A61C 17/036 134/135
6,390,104 B1 * 5/2002 Gagnon ..... A61C 17/036 134/107
2003/0066547 A1 4/2003 Burke et al.
2004/0117905 A1 * 6/2004 Gruenwald ..... A61H 33/0091 4/541.1
2005/0204467 A1 * 9/2005 Bean ..... A47K 3/022 4/622
2006/0207018 A1 * 9/2006 Lev ..... A61H 33/02 4/622
2006/0218743 A1 10/2006 Riske
2008/0099055 A1 * 5/2008 Lemley ..... A47L 15/502 134/25.2
2009/0133721 A1 5/2009 Campbell
2009/0133781 A1 * 5/2009 Issukka ..... B27B 31/04 144/378
2016/0135673 A1 * 5/2016 Miller ..... A61B 1/123 134/57 R

OTHER PUBLICATIONS

International Preliminary Report on Patentability with mailing date of Jan. 3, 2013 for international patent application No. PCT/US2011/040841 with an international filing date of Jun. 17, 2011 in the name of the same applicant.

* cited by examiner

HAND-HELD TANK FOR CLEANING CHANDELIERS

BACKGROUND OF THE INVENTION

Field of the Invention

This invention relates, generally, to the art of cleaning chandeliers or other structurally complex lighting fixtures. More particularly, it relates to a system that cleans lighting fixtures without chemicals and that protects the electrical parts of the fixture from water and chemicals.

Description of the Prior Art

Conventional chandelier cleaning requires a labor-intensive, time-consuming dismantling of the chandelier and hand washing of each part.

Conventional spray bottles rely on gravity to remove mixtures of chemicals, cold water, and dirt from the chandelier crystals and out of pooling areas. The area below a crystal or other chandelier part being cleaned is therefore soaked as that water drips. The floor or other surfaces such as tabletops below the part being cleaned must therefore be covered with a tarp or drop cloth. Floors and walls can still be marred by water as it splashes onto such tarps or drop cloths. The water, which may contain dissolved chemicals, may also damage the floor simply by flowing off the tarp or drop cloths because such protective sheets have little or no water containment ability.

Thus, there is a need for cleaning chandeliers that does not depend upon the force of gravity and which does not result in pooling of water under a part that is cleaned.

Most manufacturers of spray bottle chemical chandelier cleaners warn users to avoid fume and spray inhalation, eye contact, skin contact, and the like.

Thus, there is a need for a cleaning method that is safe to use.

Most chandelier arms, both new and antique, are held to the main frame of the chandelier by a potting material. Water is used to weaken the bond provided by the potting material when a chandelier arm is intentionally removed. Complete saturation of the potting material by chemical sprays also weakens the bond and loosens such arms when there is no intention to change them.

Thus, there is a need for a process of cleaning chandeliers that does not use chemical sprays that weaken the bond of potting material.

There is also a need for a cleaning apparatus that can clean crystal parts of a new generation of fixtures that include crystals that are mounted in upright, diagonal, and sideways configurations, and the like.

Adhesives are also used on newer fixtures to bond glass, crystals, and other parts directly to the chandelier. These adhesives may or may not be weakened by chemical cleaning sprays. However, clear epoxy may be softened and discolored over time by the application thereto of chemical sprays.

Thus, there is a need for a cleaning process that does not weaken adhesive bonds and that does not soften or discolor the clear epoxy used in chandeliers.

The use of a chemical spray bottle to clean a fixture requires spraying and re-spraying until the entire chandelier is drenched. Plastic bags are used to cover the bulb sockets. However, water and chemicals still pool in electrical junction boxes within the fixture and bowls that are common in chandeliers, thereby causing electrical shorts, corrosion, rusting, and other damage. The water can remain in such pools for days or weeks.

Thus, there is a need for an improved method of cleaning chandeliers that does not cause such pooling.

However, in view of the prior art considered as a whole at the time the present invention was made, it was not obvious to those of ordinary skill how the identified needs could be met.

SUMMARY OF THE INVENTION

The long-standing but heretofore unfulfilled need for an improved method and apparatus for cleaning chandeliers and light fixtures is now met by a new, useful, and non-obvious invention.

The novel hand-held tank for holding hot water includes a base atop which is mounted the hand-held tank. The base has a hollow interior, and the tank has sidewalls, at least one of which is transparent.

An air and water pump and a battery are mounted in the hollow interior of the base, the battery being in electrical communication with the pump.

A first inlet admits ambient air into an inlet of the pump and a second inlet admits water into the inlet of the pump.

At least one air and water-emitting nozzle is formed in a sidewall of the tank and a pump outlet is in open fluid communication with the at least one water-emitting nozzle.

Said at least one water-emitting nozzle discharges agitating water and bubbles into the hot water or above the water line, depending upon the depth of the water, to help dislodge chemicals and grease from the chandelier parts immersed in the hot water.

An interior surface of at least one sidewall is covered with splash-suppressing bristles.

A cut out area of predetermined shape is formed in a preselected sidewall of the tank and a door panel is disposed in the cut out area, said door panel being made of an flexible and resilient elastomeric material and having a frame made of a substantially rigid material.

The flexible and resilient soft rubber conforms to the shape of a chandelier arm and closes around the arm tightly to prevent hot water emitted under pressure by the jet gun from passing through the door panel.

A sump is formed in the base and an impeller is mounted for rotation in the sump. A motor is mounted in the hollow interior of the base, said motor in electrical communication with said battery. Rotation of the impeller agitates the hot water in the tank.

An important object of the invention is to provide a chandelier cleaning apparatus that does not employ chemicals.

Another important object is to provide a chandelier cleaning apparatus that does not require the chandelier to be disassembled during cleaning.

Yet another important object is to provide a hands-free, touch free chandelier cleaning apparatus.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
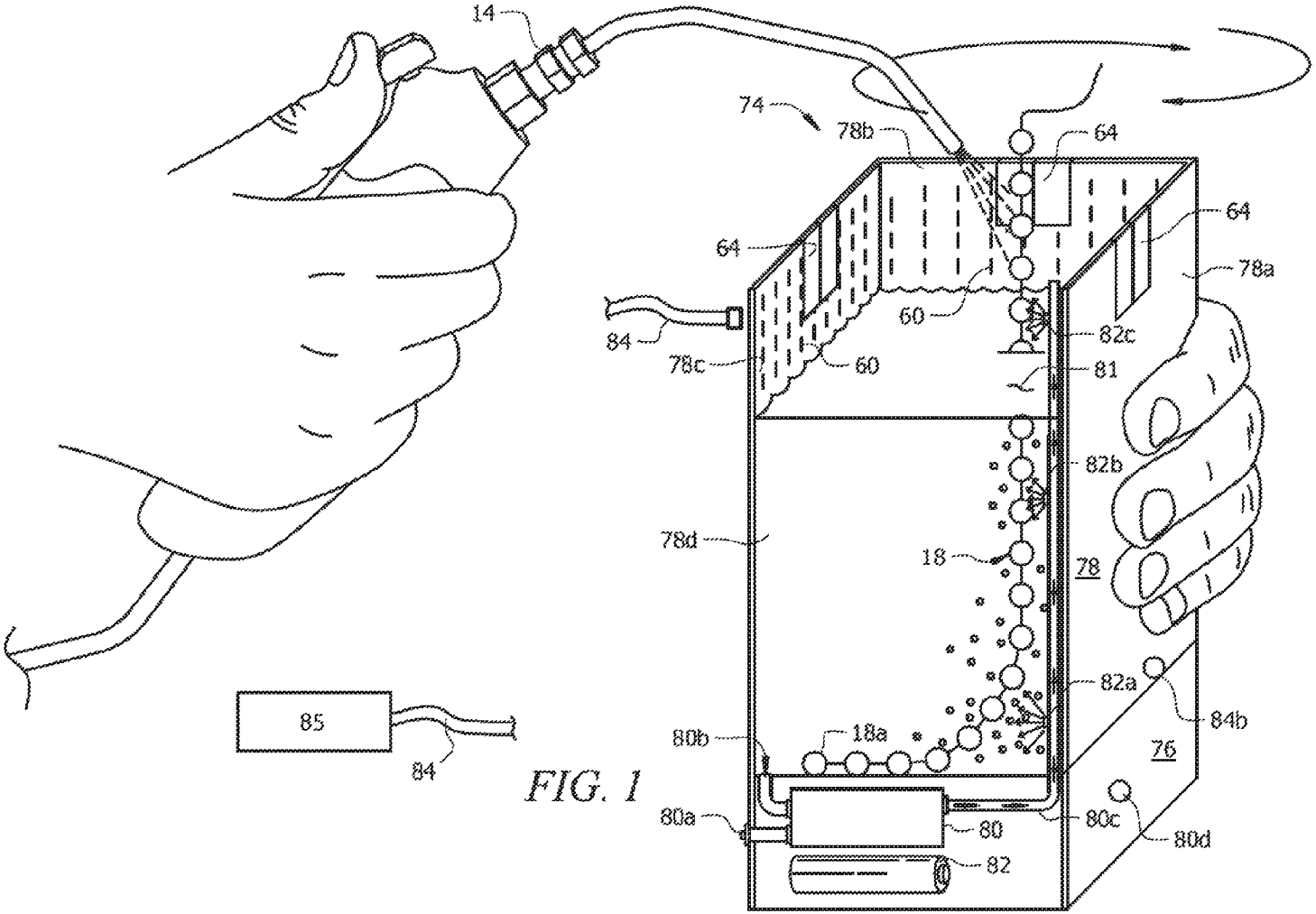
FIG. 1 is a perspective view of the novel tank.
Figure 2:
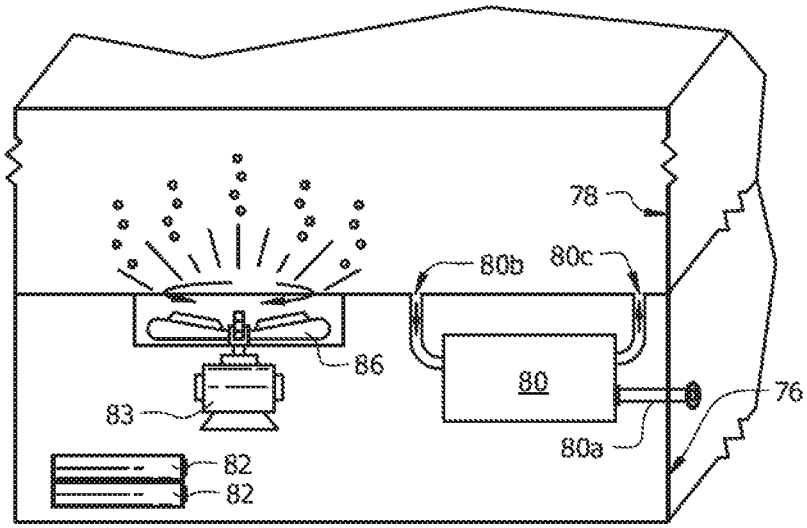
FIG. 2 is a side elevational view of a variation of the FIG. 1 embodiment.

An embodiment of the novel quaff that provides a two-stage cleaning process is depicted in FIGS. 1 and 2. It is not referred to as a vacuum shield because the term "shield" implies a flat, substantially two-dimensional object whereas the quaff of FIGS. 1 and 2 includes a three-dimensional tank that holds hot water. Quaff 74 may be hand-held as depicted or it may be mechanically mounted on a suitable support means such as an upstanding pole or post, not depicted.

Quaff 74 includes base 76 atop which is mounted tank 78 having sidewalls 78*a*, 78*b*, 78*c* and 78*d*, one or more of which may be transparent. This embodiment of quaff 74 substantially eliminates the need for a drain hose because water from nozzles 82*a*, 82*b*, and 82*c* accumulates in tank 78.

Air and water pump 80 is mounted in the hollow interior of base 76, together with battery 82 that provides power to pump 80 so that quaff 74 can be easily maneuvered without the impediment of a power cord. Inlet 80*a* admits ambient air into the inlet of pump 80 and inlet 80*b* admits water into said inlet of said pump. Pump outlet 80*c* is in open fluid communication with nozzles or jets 82*a*, 82*b*, and 82*c* that discharge agitating water and bubbles into the hot water or above the water line, depending upon the depth of the water, having surface 81 in tank 78, to help dislodge chemicals and grease from the chandelier parts immersed in said hot water as depicted. Switch actuator 80*d* is pressed to turn pump 80 on or off.

Bristles 60 and doors 64 perform the same function in this embodiment as performed in the two-dimensional version of quaff 74 as disclosed in the incorporated application.

As water from jet gun 14 accumulates within tank 78, vacuum hose 84 serves as a drain intake, keeping the water level substantially constant and removing water from the tank so that the tank water remains hot. Vacuum hose 84 attached to vacuum pump 85 and may directly attach to drain outlet 84*b* formed in tank 78. Vacuum hose 84 also serves to skim floating dust or debris from the surface of water 84. Vacuum hose 84 is optional equipment and is not often needed because tank 78 will not approach full capacity on most chandelier cleaning jobs.

Further agitation may also be provided by fan or impeller 86, depicted in FIG. 2. Said impeller 86 is preferably positioned in a screen-covered sump at the bottom of tank 78 so that it agitates the hot water in tank 78 when rotated by battery-operated motor 83. In the variation of FIG. 2, water outlet 80*c* of pump 80 is in open fluid communication with the hot water in tank 78 and jet nozzles 82*a*, 82*b*, and 82*c* are not used. However, both embodiments are within the scope of the invention and both embodiments may be used in conjunction with or without impeller 86.

As depicted in FIG. 1, it is clear that immersed crystals 18 are cleaned by the agitated hot water in the absence of chemicals. Hot water is advantageously poured into tank 78 at the beginning of the cleaning process to a shallow depth so that a horizontal section 18*a* of crystal 18 is pre-soaked. Moreover, as crystals 18 are lifted from the hot water as quaff 74 is lowered, they are rinsed above water surface 81 by jet gun 14. If water level 81 is high as depicted, crystals 18 may be rinsed by jet gun 14, by nozzle 82*c*, or both. If water level 81 is below nozzle 82*b*, that nozzle may also serve to rinse the crystals. If water level 81 is very low, nozzle 82*a* may also provide rinsing. Crystals 18 thereby receive an under water pre-soaking as well as an above water rinsing. This two-step cleaning process effectively removes chemicals and grease.

The novel apparatus has many advantages. It enables a chandelier to be cleaned much faster than conventional methods because the user need not touch or remove any of the crystals. Moreover, it cleans areas that cannot be accessed by other cleaning systems or hand cleaning unless crystals are removed. Crystal removal is very undesirable because chandeliers may have as few as one hundred (100) parts or as many as one hundred thousand (100,000) parts.

The novel method also avoids the use of chemical sprays. Such sprays can break down the lacquer coating that protects the metallic parts of the chandelier, thereby enabling corrosion and darkening of the metallic surfaces over time.

It also eliminates the prior art need to protect light bulbs and electrical sockets to protect them from water, thereby saving even more time.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for cleaning chandeliers, comprising:

a hand-held tank for holding hot water;

a base atop which is mounted said hand-held tank, said base having a hollow interior;

said base further includes:

a sump formed in said base, said sump includes an impeller for rotation in said sump, whereby rotation of said impeller agitates the hot water in said tank;

a motor mounted in said hollow interior of said base, said motor in electrical communication with a battery in said base and in communication with said impeller;

said tank having sidewalls, at least one of which is transparent;

an air and water pump mounted in the hollow interior of said base;

said battery in electrical communication with said pump;

a first inlet that admits ambient air into an inlet of said pump;

a second inlet that admits water into said inlet of said pump;

at least one air and water-emitting nozzle formed in a sidewall of said tank;

a pump outlet in open fluid communication with said at least one water-emitting nozzle;

whereby said at least one nozzle discharges agitating water and bubbles into the hot water or above the water line, depending upon the depth of the water, to help dislodge chemicals and grease from the chandelier parts immersed in said hot water and a cut out area of predetermined shape formed in a preselected one of said sidewalls of said tank; a door panel disposed in said cut out area, said door panel being made of a flexible and resilient elastomeric material and having a frame made of a substantially rigid material; said flexible and resilient elastomeric material conforming to the shape of a chandelier arm and closing around said arm tightly to prevent hot water emitted under pressure by said water-emitting nozzle from passing through said door panel.

2. The apparatus of claim 1, further comprising:

said sidewalls extending vertically from said base; and an interior surface of at least one of said sidewalls being covered with splash-suppressing bristles.

3. The apparatus of claim 1, further comprising:

a drain outlet formed in said hand-held tank;

a vacuum hose having a first end in open communication with a remote vacuum pump and a second end in open communication with said drain outlet;

whereby said vacuum hose maintains a substantially constant water level within said hand-held tank, removes water from the hand-held tank so that the water therein remains hot and so that floating dust or debris is skimmed from the surface of said water in said handheld tank.

4. The apparatus of claim 1, further comprising:

a screen that overlies said sump to prevent chandelier crystals from entering into said sump.

* * * * *